US010794147B2

(12) United States Patent
Burris et al.

(10) Patent No.: US 10,794,147 B2
(45) Date of Patent: Oct. 6, 2020

(54) DOWNHOLE COMPONENT INCLUDING A UNITARY BODY HAVING AN INTERNAL ANNULAR CHAMBER AND FLUID PASSAGES

(71) Applicants: John Burris, Bixby, OK (US); Jason Edwards, Broken Arrow, OK (US); Samuel C. Kucera, Nixa, MO (US)

(72) Inventors: John Burris, Bixby, OK (US); Jason Edwards, Broken Arrow, OK (US); Samuel C. Kucera, Nixa, MO (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 223 days.

(21) Appl. No.: 15/971,000

(22) Filed: May 4, 2018

(65) Prior Publication Data

US 2019/0338620 A1 Nov. 7, 2019

(51) Int. Cl.
*E21B 34/10* (2006.01)
*E21B 34/14* (2006.01)

(52) U.S. Cl.
CPC ..... *E21B 34/10* (2013.01); *E21B 34/14* (2013.01)

(58) Field of Classification Search
CPC ..... E21B 34/10
See application file for complete search history.

(56) References Cited

U.S. PATENT DOCUMENTS

| | | | | |
|---|---|---|---|---|
| 4,407,329 | A | 10/1983 | Huebsch et al. | |
| 4,676,307 | A | 6/1987 | Pringle | |
| 5,022,427 | A | 6/1991 | Churchman et al. | |
| 5,496,044 | A | 3/1996 | Beall et al. | |
| 2015/0211333 | A1* | 7/2015 | Vick, Jr. ..... | E21B 34/066 166/375 |
| 2018/0334883 | A1* | 11/2018 | Williamson ..... | E21B 34/102 |

FOREIGN PATENT DOCUMENTS

WO 2007073401 A1 6/2007

OTHER PUBLICATIONS

International Search Report and Written Opinion for International Application No. PCT/US2019/026878; International Filing Date Apr. 11, 2019; Report dated Jul. 26, 2019 (pp. 1-8).

* cited by examiner

*Primary Examiner* — Kristyn A Hall
*Assistant Examiner* — Dany E Akakpo
(74) *Attorney, Agent, or Firm* — Cantor Colburn LLP

(57) ABSTRACT

A downhole component includes a unitary body having a first end portion, a second end portion and an intermediate portion extending therebetween. The intermediate portion defines an outer surface and an inner surface forming a flow path. An annular chamber has a first end section spaced from a second end section by a gap. The annular chamber is formed in the unitary body spaced from the first end portion, the second end portion, the outer surface, and the inner surface.

17 Claims, 7 Drawing Sheets

DOWNHOLE COMPONENT INCLUDING A UNITARY BODY HAVING AN INTERNAL ANNULAR CHAMBER AND FLUID PASSAGES

BACKGROUND

In the resource exploration and recovery pressure chambers are often used to actuate various components. Often times, a control pressure may be applied to, for example, a piston supported in the pressure chamber. The piston may be used to selectively activate, for example, a subsurface safety valve. Of course, the control pressure may be employed to activate other subsurface devices. In some cases, the pressure chamber includes an annular chamber or a partially annular chamber that may be selectively punctured so that fluid may flow through the pressure chamber in the event of a piston failure.

Generally, the pressure chamber is part of a tool or conduit formed of at least two mated components. The partially annular chamber is formed in one, or both mating surfaces of the two mated components. A seal is provided to ensure that pressure and fluid do not breach a joint formed by joining the two mated components. The seal and joint represent a potential leak path. Additionally, forming mating components increases an overall cost and complexity of manufacture and maintenance. Therefore, the art would be appreciate a pressure chamber that includes fewer leak paths and which is more efficient to manufacture and maintain.

SUMMARY

Disclosed is a downhole component including a unitary body having a first end portion, a second end portion and an intermediate portion extending therebetween. The intermediate portion defines an outer surface and an inner surface forming a flow path. An annular chamber has a first end section spaced from a second end section by a gap. The annular chamber is formed in the unitary body spaced from the first end portion, the second end portion, the outer surface, and the inner surface.

Also disclosed is a downhole system including a tubular having a tool mechanism and a downhole component mechanically connected to the tubular. The downhole component includes a unitary body having a first end portion, a second end portion and an intermediate portion extending therebetween. The intermediate portion defines an outer surface and an inner surface forming a flow path. An annular chamber has a first end section spaced from a second end section by a gap. The annular chamber is formed in the unitary body spaced from the first end portion, the second end portion, the outer surface, and the inner surface.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
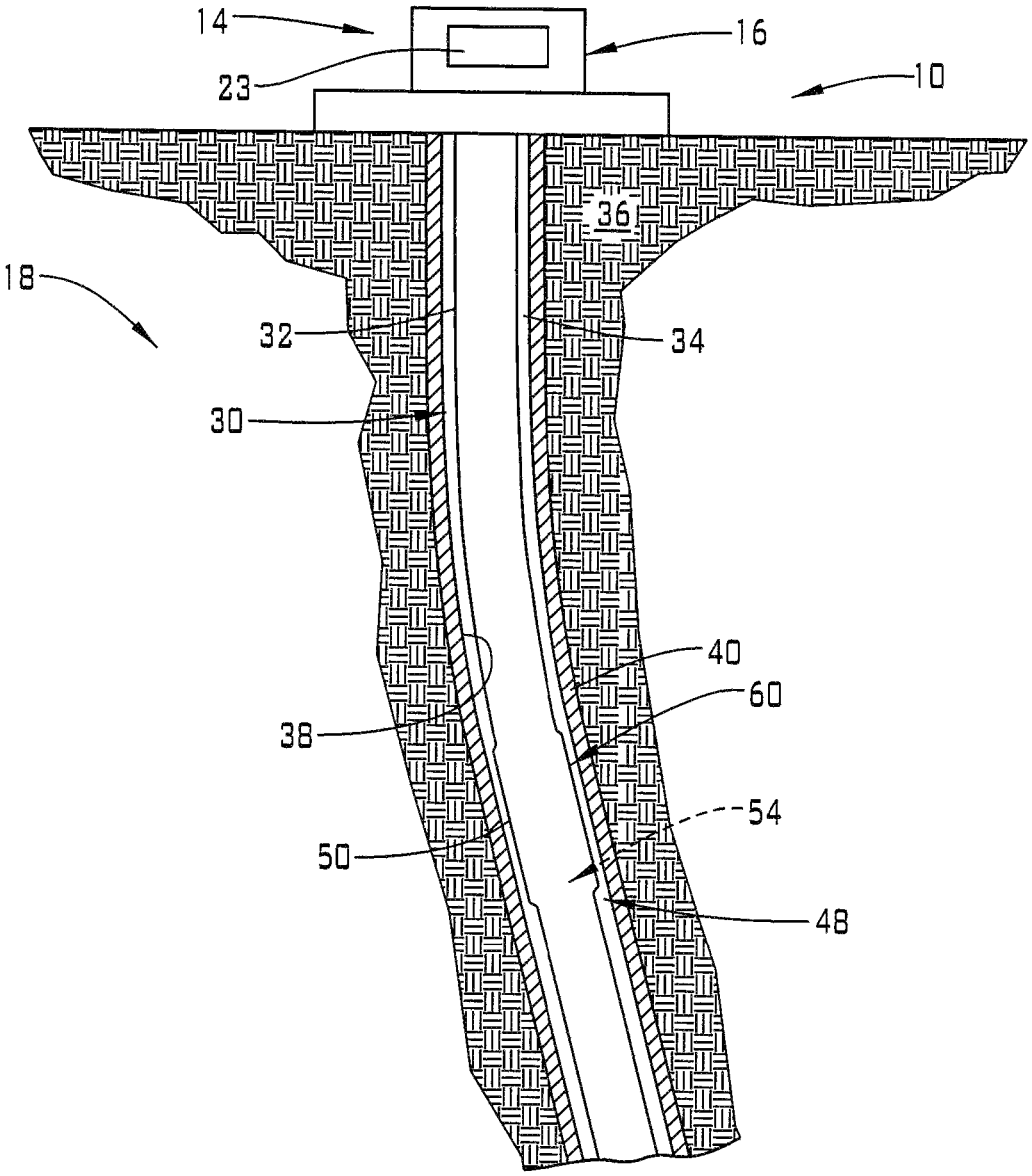
FIG. 1 depicts a resource exploration and recovery system including a downhole component including a unitary body having an internal annular chamber and fluid passages in accordance with an exemplary embodiment.

A resource exploration and recovery system, in accordance with an exemplary embodiment, is indicated generally at 10, in FIG. 1. Resource exploration and recovery system 10 should be understood to include well drilling operations, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a downhole system. First system 14 may include a control system 23 that may provide power to, monitor, communicate with, and/or activate one or more downhole operations as will be discussed herein. Surface system 16 may include additional systems such as pumps, fluid storage systems, cranes and the like (not shown).

Second system 18 may include a tubular string 30, formed from one or more tubulars 32, which extends into a wellbore 34 formed in formation 36. Wellbore 34 includes an annular wall 38 which may be defined by a surface of formation 36, or a casing tubular 40 such as shown. In an exemplary aspect, tubular string 30 supports a downhole system 48 including a tubular 50 that houses a tool mechanism 54. A downhole component 60 may be coupled with tubular 50 for purposes of activating tool mechanism 54.

Figure 2:
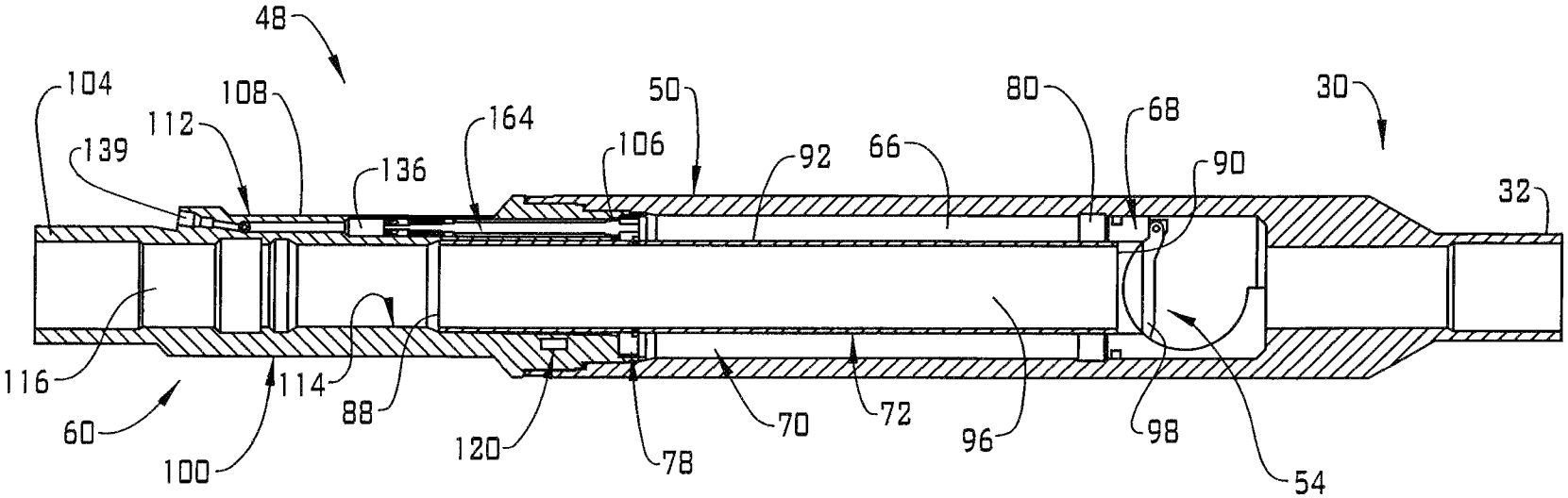
FIG. 2 depicts a downhole system including a tubular having a tool mechanism shown in a first position and a downhole component, in accordance with an exemplary aspect.
Figure 3:
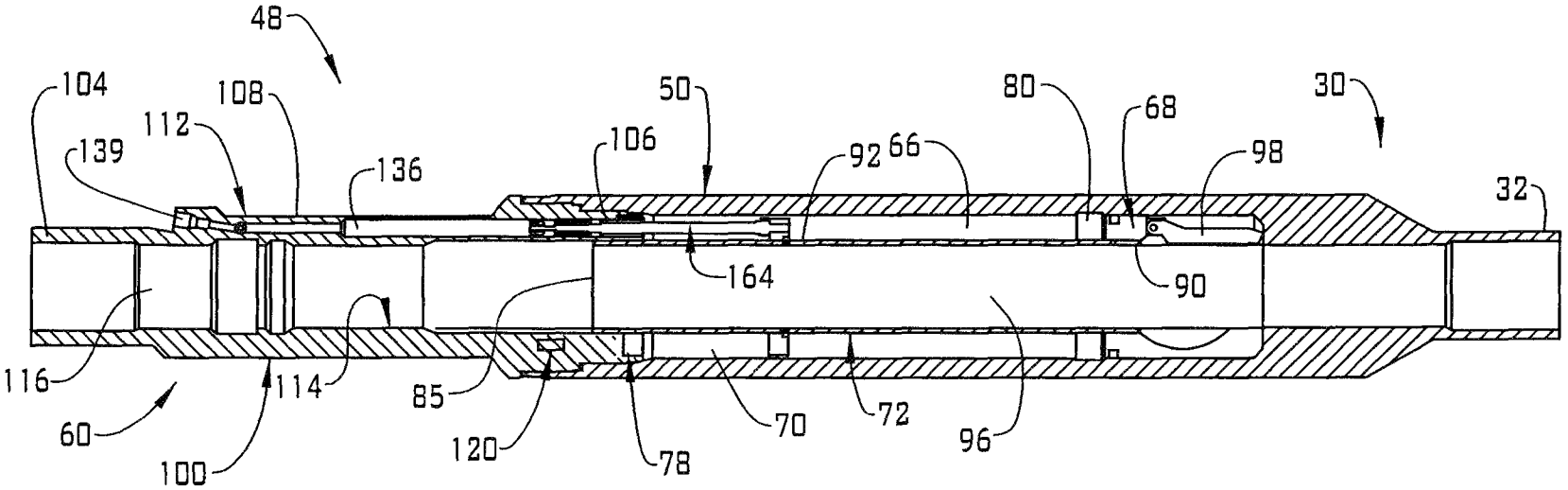
FIG. 3 depicts a downhole system including a tubular having a tool mechanism shown in a second position and a downhole component, in accordance with an exemplary aspect.

Referring to FIGS. 2 and 3, tubular 50 includes an inner passage 66 within which resides tool mechanism 54. In an embodiment, tool mechanism 54 is depicted as a subsurface safety valve (SSSV) 68. However, it should be understood that tool mechanism 54 may take on various forms. Tool mechanism 54 also includes an actuator 70 including a flow tube 72 supported within inner passage 66 by a first support collar 78 and a second support collar 80.

Flow tube 72 includes a first end 88, a second end 90 and an intermediate section 92 that defines a conduit 96. First support collar 78 is arranged at intermediate section 92 and second support collar 80 is arranged at second end 90. First support collar 78 may be connected to downhole component 60 to axially shift flow tube 72 along inner passage 66. More specifically, as will be detailed more fully herein, downhole component 60 shifts flow tube 72 into contact with a flapper 98 to shift SSV 68 from a closed configuration (FIG. 2) to an open configuration (FIG. 3).

Figure 4:
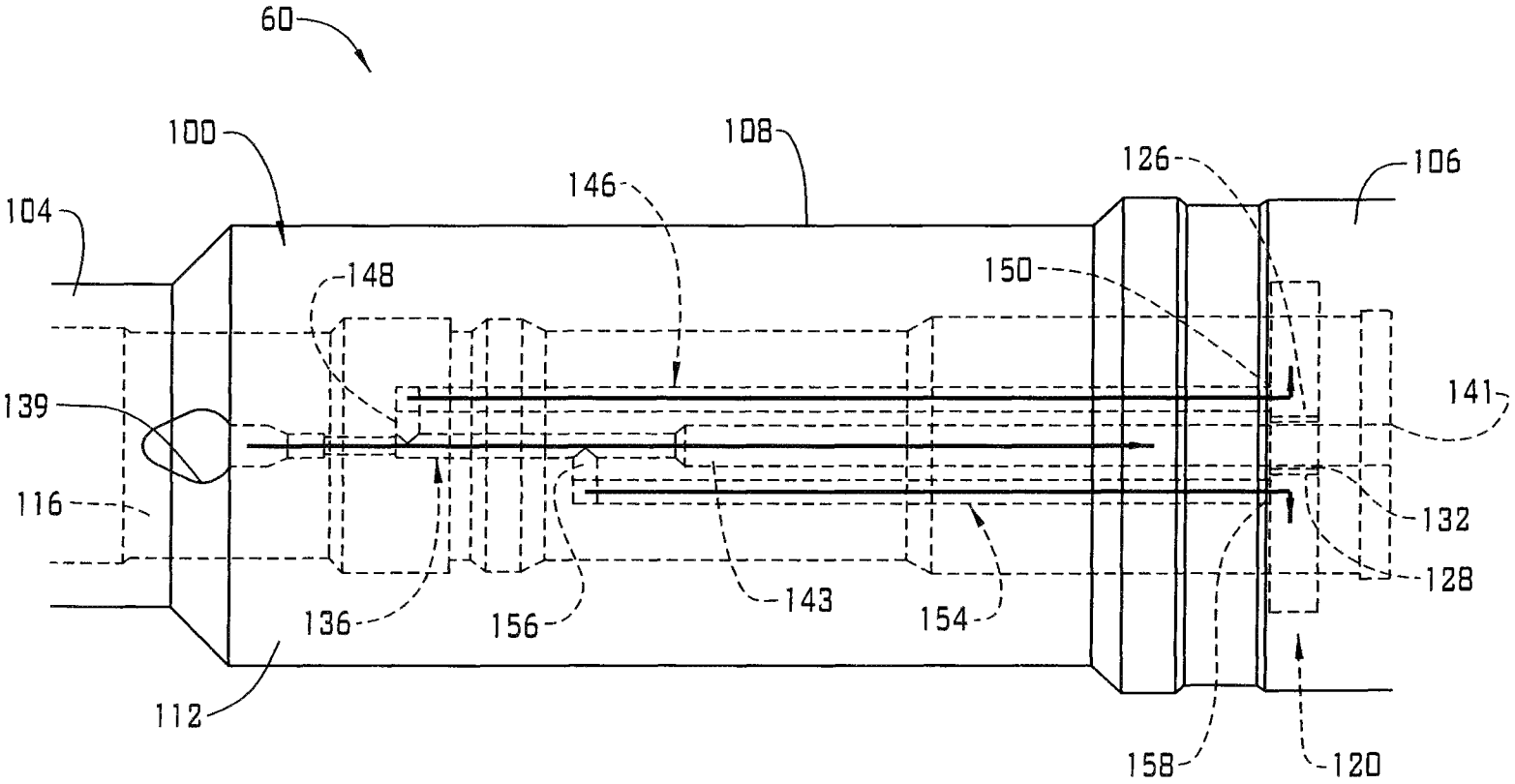
FIG. 4 depicts the downhole component, in accordance with an exemplary aspect.
Figure 5:
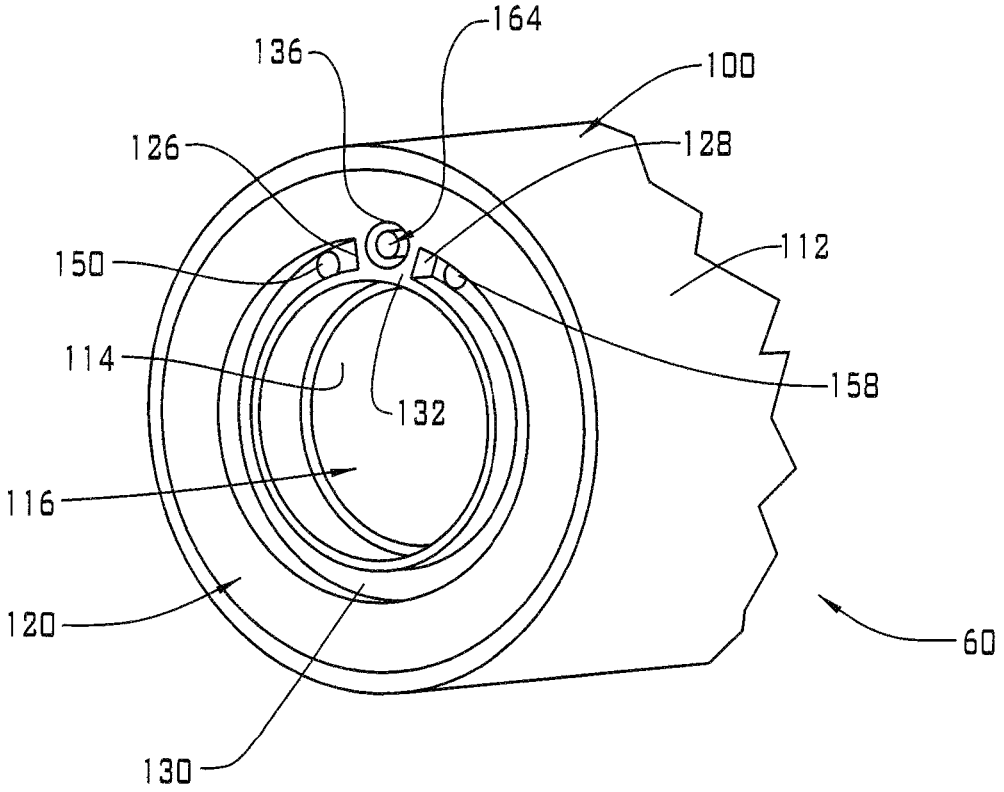
FIG. 5 depicts a partial cross sectional perspective view of internal fluid passages of the downhole component of FIG. 4.

Referring to FIGS. 4 and 5 and with continued reference to FIGS. 2 and 3, downhole component 60, in accordance with an exemplary aspect, includes a unitary body 100. The term "unitary" should be understood to describe a component that is made as a single piece without joints, seams, or the like. In an embodiment, unitary body 100 is formed in an additive manufacturing process. Unitary body 100 includes a first end portion 104, a second end portion 106 and an intermediate portion 108 extending therebetween. Unitary body 100 also includes an outer surface 112 and an inner surface 114 that defines a flow path 116 that registers with conduit 96.

In accordance with an exemplary aspect, unitary body 100 includes an annular chamber 120. Annular chamber 120 extends annularly about a portion of unitary body 100 between outer surface 112 and inner surface 114. At this point, it should be understood that the term "annular" includes a full annular chamber e.g., a chamber that extends a full 360-degrees as well as partially annular chambers or chambers that extend less than a full 360-degrees. Annular chamber 120 includes a first end section 126, a second end section 128 and an intermediate section 130. First end section 126 is spaced from second end section 128 by a gap 132. Annular chamber 120 is not exposed to flow path 116 during normal operating conditions. However, as will be discussed more fully herein, annular chamber 120 may be punctured and fluidically connected with flow path 116.

In further accordance with an exemplary aspect, an axial passage 136 extends through unitary body 100. Axial passage 136 includes a first end 139 exposed at outer surface 112, a second end 141 that is exposed at second end portion 106 and an intermediate portion 143 that is formed between outer surface 112 and inner surface 114. A first secondary axial passage 146 extends alongside axial passage 136. First secondary axial passage 146 includes a first end section 148 fluidically connected to axial passage 136, a second end section 150 fluidically connected to annular chamber 120.

Additionally, a second secondary axial passage 154 extends alongside axial passage 136. Second secondary axial passage 154 includes a first end section 156 fluidically connected to axial passage 136 between first end section 148 of first secondary axial passage 146 and annular chamber 120. Second secondary axial passage 154 also includes a second end section 158 fluidically connected to annular chamber 120. A piston 164 is arranged in axial passage 136 and is mechanically connected to first support collar 78. Piston 164 may be acted upon by, for example, hydraulic pressure to shift flow tube 72 passed valve member 84 to open SSV 68.

Figure 6:
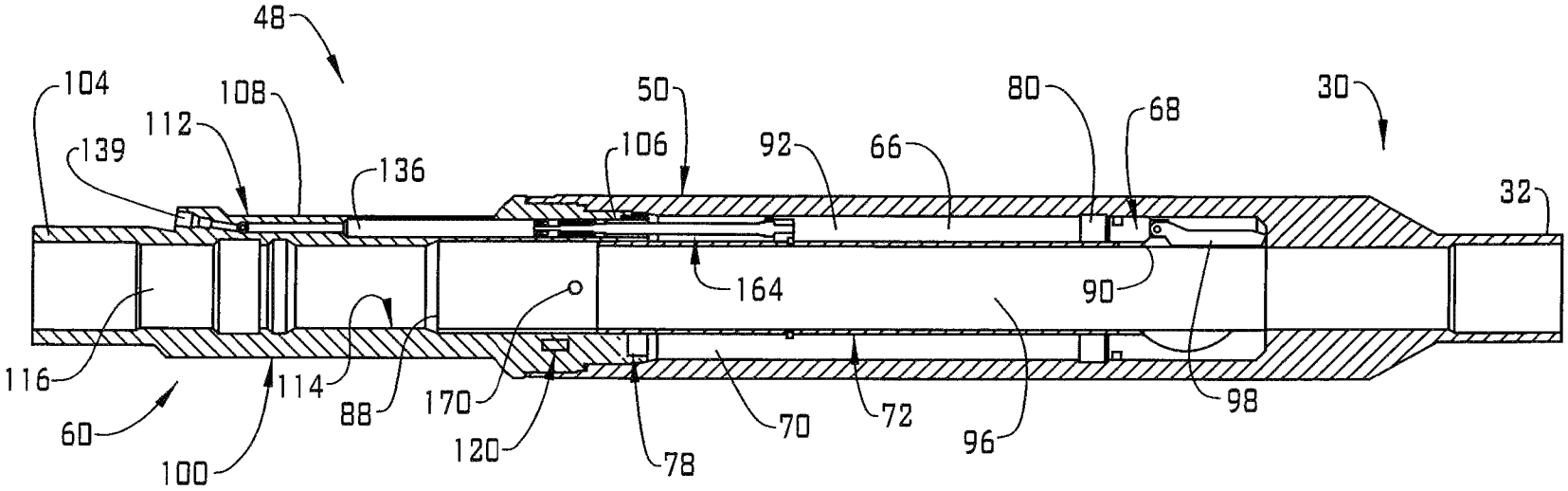
FIG. 6 depicts the downhole system of FIG. 4 following a breaching operation.
Figure 7:
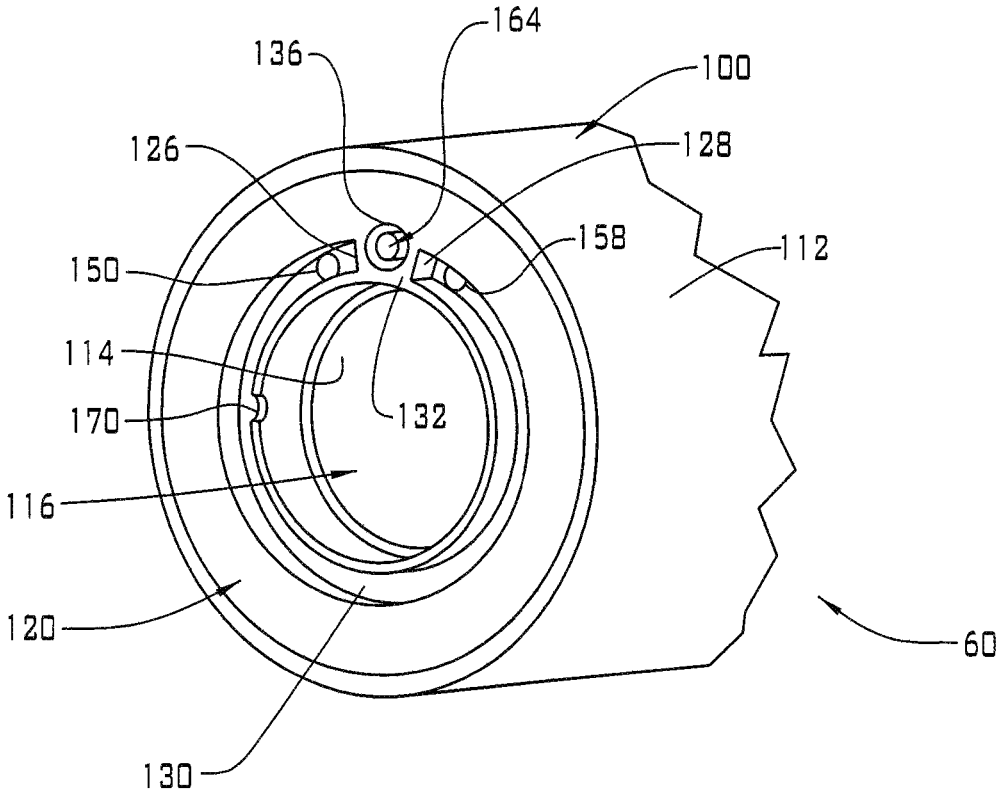
FIG. 7 depicts a partial cross sectional perspective view of an opening formed in the internal annular chamber following the breaching operation.

In accordance with an exemplary aspect, in the event that piston 164 becomes stuck, an opening 170 may be formed through annular chamber 120 to provide an auxiliary control flow path such as shown in FIGS. 6 and 7. Specifically, a puncture communication tool (not shown) may be run down hole into axial passage 136. The puncture communication tool may act upon a terminal end of piston 164 causing a radially outward puncture through annular chamber 120. The radial outward puncture creates opening 170 to provide the auxiliary control flow path.

At this point it should be appreciated that the exemplary embodiments describe a downhole component having a unitary body that may function in a manner similar to previous components formed from multiple pieces. By creating a unitary body, leak paths are eliminated thereby decreasing maintenance and repair costs. Further, the formation of the unitary body allows the creation of multiple flow paths that were previously only achievable through the use of multiple components, complex machining operations, multiple seals and high assembly costs.

Set forth below are some embodiments of the foregoing disclosure:

Embodiment 1: A downhole component including: a unitary body including a first end portion, a second end portion and an intermediate portion extending therebetween, the intermediate portion defining an outer surface and an inner surface forming a flow path; and an annular chamber having a first end section spaced from a second end section by a gap, the annular chamber being formed in the unitary body spaced from the first end portion, the second end portion, the outer surface, and the inner surface.

Embodiment 2: The downhole component as in any prior embodiment, further including: an axial passage including a first end exposed at the outer surface, a second end exposed at the second end portion, and an intermediate portion extending therebetween.

Embodiment 3: The downhole component as in any prior embodiment, further including: a piston arranged in the axial passage.

Embodiment 4: The downhole component as in any prior embodiment, further including: a first secondary axial passage formed in the unitary body, the first secondary axial passage including a first end section fluidically connected to the axial passage and a second end section fluidically connected to the annular chamber.

Embodiment 5: The downhole component as in any prior embodiment, further comprising: a second secondary axial passages formed in the unitary body, the second axial passage including a third end section fluidically connected to the axial passage and a fourth end section fluidically connected to the annular chamber.

Embodiment 6: The downhole component as in any prior embodiment, wherein the third end section is fluidically connected to the intermediate portion between the first end section and the annular chamber.

Embodiment 7: The downhole component as in any prior embodiment, wherein the unitary body is additively manufactured.

Embodiment 8: The downhole component as in any prior embodiment, wherein the annular chamber is selectively, fluidically connected to the flow path through the inner surface.

Embodiment 9: A downhole system including: a tubular including a tool mechanism; and a downhole component mechanically connected to the tubular, the downhole component including: a unitary body including a first end portion, a second end portion and an intermediate portion extending therebetween, the intermediate portion defining an outer surface and an inner surface forming a flow path; and an annular chamber having a first end section spaced from a second end section by a gap, the annular chamber being formed in the unitary body spaced from the first end portion, the second end portion, the outer surface, and the inner surface.

Embodiment 10: The downhole system as in any prior embodiment, further including: an axial passage including a first end exposed at the outer surface, a second end exposed at the second end portion, and an intermediate portion extending therebetween.

Embodiment 11: The downhole system as in any prior embodiment, further comprising: a piston arranged in the axial passage.

Embodiment 12: The downhole system as in any prior embodiment, further comprising: an actuator operatively connected to the piston and the tool mechanism.

Embodiment 13: The downhole system as in any prior embodiment, wherein the tool mechanism comprises a subsurface safety valve (SSSV).

Embodiment 14: The downhole system as in any prior embodiment, wherein the actuator includes a tubular that is selectively shiftable through the SSSV.

Embodiment 15: The downhole system as in any prior embodiment, further comprising: a first secondary axial passage formed in the unitary body, the first secondary axial passage including a first end section fluidically connected to the axial passage and a second end section fluidically connected to the annular chamber.

Embodiment 16: The downhole system as in any prior embodiment, further comprising: a second secondary axial passage formed in the unitary body, the second secondary axial passage including a third end section fluidically connected to the axial passage and a fourth end section fluidically connected to the annular chamber.

Embodiment 17: The downhole system as in any prior embodiment, wherein the third end section is fluidically connected to the intermediate portion between the first end section and the annular chamber.

Embodiment 18: The downhole system as in any prior embodiment, wherein the unitary body is additively manufactured.

Embodiment 19: The downhole system as in any prior embodiment, wherein the annular chamber is selectively, fluidically connected to the flow path through the inner surface.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole component comprising:

a unitary body including a first end portion, a second end portion and an intermediate portion extending therebetween, the intermediate portion defining an outer surface and an inner surface forming a flow path; and an annular chamber having a first end section spaced from a second end section by a gap, the annular chamber being formed in the unitary body spaced from the first end portion, the second end portion, the outer surface, and the inner surface, wherein the annular chamber is selectively, fluidically connected to the flow path through the inner surface.

2. The downhole component according to claim 1, further comprising: an axial passage including a first end exposed at the outer surface and a second end exposed at the second end portion.

3. The downhole component according to claim 2, further comprising: a piston arranged in the axial passage.

4. The downhole component according to claim 2, further comprising: a first secondary axial passage formed in the unitary body, the first secondary axial passage including a first end section fluidically connected to the axial passage and a second end section fluidically connected to the annular chamber.

5. The downhole component according to claim 4, further comprising: a second secondary axial passage formed in the unitary body, the second axial passage including a third end section fluidically connected to the axial passage and a fourth end section fluidically connected to the annular chamber.

6. The downhole component according to claim 5, wherein the third end section is fluidically connected to the axial passage between the first end section and the annular chamber.

7. The downhole component according to claim 1, wherein the unitary body is additively manufactured.

8. A downhole system comprising:

a tubular including a tool mechanism; and a downhole component mechanically connected to the tubular, the downhole component comprising:

a unitary body including a first end portion, a second end portion and an intermediate portion extending therebetween, the intermediate portion defining an outer surface and an inner surface forming a flow path; and an annular chamber having a first end section spaced from a second end section by a gap, the annular chamber being formed in the unitary body spaced from the first end portion, the second end portion, the outer surface, and the inner surface, wherein the annular chamber is selectively, fluidically connected to the flow path through the inner surface.

9. The downhole system according to claim 8, further comprising: an axial passage including a first end exposed at the outer surface and a second end exposed at the second end portion.

10. The downhole system according to claim 9, further comprising: a piston arranged in the axial passage.

11. The downhole system according to claim 10, further comprising: an actuator operatively connected to the piston and the tool mechanism.

12. The downhole system according to claim 11, wherein the tool mechanism comprises a subsurface safety valve (SSSV).

13. The downhole system according to claim 12, wherein the actuator includes an actuator tubular that is selectively shiftable through the SSSV.

14. The downhole system according to claim 9, further comprising: a first secondary axial passage formed in the unitary body, the first secondary axial passage including a first end section fluidically connected to the axial passage and a second end section fluidically connected to the annular chamber.

15. The downhole system according to claim 14, further comprising: a second secondary axial passage formed in the unitary body, the second secondary axial passage including a third end section fluidically connected to the axial passage and a fourth end section fluidically connected to the annular chamber.

16. The downhole system according to claim 15, wherein the third end section is fluidically connected to the axial passage between the first end section and the annular chamber.

17. The downhole system according to claim 8, wherein the unitary body is additively manufactured.

* * * * *